United States Patent [19]

Bourbon

[11] Patent Number: 4,666,036

[45] Date of Patent: May 19, 1987

[54] DISPLAY CONTAINER

[75] Inventor: Jean Bourbon, Saint Lupicin, France

[73] Assignee: Ets A. Bourbon & Fils, Saint Lupicin, France

[21] Appl. No.: 787,916

[22] Filed: Oct. 16, 1985

[30] Foreign Application Priority Data

Oct. 16, 1984 [FR] France ..... 84 16224

[51] Int. Cl.[4] ..... B65D 5/52

[52] U.S. Cl. ..... 206/45.23; 206/45.14; 206/45.20; 206/45.15; 206/45.18; 206/45.24; 206/425; 220/329; 220/331; 220/337; 220/338

[58] Field of Search ..... 206/45.15, 45.18, 45.20, 206/45.23, 45.24, 215, 309, 387, 425, 444, 45.14; 220/329, 331, 335, 334, 337, 338, 341, 342

[56] References Cited

U.S. PATENT DOCUMENTS

| | | | |
|---|---|---|---|
| 1,720,274 | 7/1929 | Holden | 206/45.23 |
| 2,460,488 | 2/1949 | Brunetti | 220/338 |
| 2,897,034 | 7/1959 | Kalen | 206/45.23 |
| 3,333,726 | 8/1967 | Belanger | 220/337 |
| 3,984,028 | 10/1976 | Zinnbauer | 220/337 |
| 4,029,234 | 6/1977 | Johnson, Jr. et al. | 220/337 |
| 4,203,529 | 5/1980 | Torassa et al. | 220/337 |
| 4,369,879 | 1/1983 | Egly et al. | 206/45.18 |
| 4,420,079 | 12/1983 | Gliniorz et al. | 206/45.23 |
| 4,478,335 | 10/1984 | Long et al. | 206/446 |
| 4,515,419 | 5/1985 | Hampel et al. | 206/45.23 |
| 4,527,690 | 7/1985 | Schmidts et al. | 206/45.15 |
| 4,540,090 | 9/1985 | Gelardi et al. | 206/387 |

FOREIGN PATENT DOCUMENTS

| | | | |
|---|---|---|---|
| 50639 | 11/1911 | Austria | 206/45.23 |
| 66273 | 12/1982 | European Pat. Off. | 206/45.15 |

*Primary Examiner*—Joseph Man-Fu Moy
*Assistant Examiner*—David T. Fidei
*Attorney, Agent, or Firm*—Karl F. Ross; Herbert Dubno

[57] ABSTRACT

A parallelepipedal container for displaying and affording access to pencils, cards, diskettes and the like has box-like complementary upper and lower members and extended arms of the upper member which have pins engaging in slots in side walls of the lower member so that a linear displacement of the upper member only is permissible through a distance equal in distance to the difference in height of the front and rear walls of the lower member before the upper member can be pivoted rearwardly to form a stand for the container.

9 Claims, 4 Drawing Figures

DISPLAY CONTAINER

FIELD OF THE INVENTION

My present invention relates to a display container and, more particularly, to a box which can store in an effectively closed manner, a variety of objects, e.g. cards, computer diskettes, records, pencils and the like, and which comprises a cover which can be displaced relative to a lower part of the box into a position in which the cover assists in supporting the container in an open position for convenient display of, and access to, the objects contained therein.

BACKGROUND OF THE INVENTION

Box-like or parallelepipedal containers for the purposes described have, in the past, generally comprised an upwardly open lower part having front, back and side walls, as well as a bottom, and a cover which, when in place to close the container, had front, back and side walls generally lying flush with the corresponding walls of the container bottom.

The rear wall of the container bottom usually was higher than the front wall thereof to facilitate display of the articles from the front and access to the articles through the open top of the container.

The closure or cover member was pivotally mounted on the bottom member and could be swingable forwardly and below the bottom member through approximately ¾ of a complete revolution so as ultimately to lie rearwardly of this bottom member and form a brace, strut or stand for the bottom member, thereby enabling the latter to rest firmly upon a table top, desk top or other surface.

This system has the disadvantage that the practically complete revolution of the cover is an awkward movement for the user and, further, is inconvenient because it requires lifting of the assembly to allow the cover to swing past and beneath the bottom of the lower member. Closing of the container is equally awkward.

OBJECTS OF THE INVENTION

It is the principal object of my present invention to provide a closeable, box-like container whereby these disadvantages are obviated.

Another object of the invention is to provide a container for the purposes described in which both the opening and the closing movements are simplified.

It is also an object of my invention to provide an improved box-like container for the display of cards, informational disks, pencils and the like which allows the container to be transformed from a completely closed and practically sealed unit into a display unit facilitating access to the contents thereof.

SUMMARY OF THE INVENTION

These objects are attained in accordance with the present invention with a container basically of the type described, i.e. of a parallelepiped construction with a lower member which is upwardly open and defined by a rear wall, a front wall, a pair of side walls and a bottom wall, in which the rear wall is higher than the front wall so that the contents of the container will be readily visible and accessible upon displacement of the cover from a closed position on the lower member, the cover having front, rear and side walls as well.

According to the invention, the cover or upper member is formed with a pair of arms extending the side walls and these arms and the side walls of the lower member are provided with mutually engaging means enabling linear displacement of the lower ends of these arms upwardly along the lower member until these lower arms reach an upper position along the side walls of the upper member at which the latter means enables rearward pivoting of the cover member to open the container and form a stand or support for the latter.

Since the front and rear walls of the cover are complementary to the front and rear walls of the lower member, the front wall of the cover will be longer than the rear wall thereof and the linear displacement should be such as to enable the cover to reach a point, before pivoting is allowed, which will enable the longer front wall of the cover member to clear the top of the rear wall of the lower member.

Consequently, the sliding movement of the cover along the side walls permits the rearward pivoting of the cover directly and through a substantially lesser angle than has hitherto been required for the opening of such containers.

The aforementioned means can comprise rectilinear slots formed in the side walls of the lower member and pins formed in the lower arms of the cover which project into these slots.

Each of the pins may be provided with a respective transversely elongated head (which can be substantially rectangular) and which, for assembly, can enter into a keyhole enlargement at the lower end of the respective slot. Furthermore, on the inner face of each side wall, at the upper end of the respective slot, a recess may be formed to allow rotatable movement of the respective head to pivotally accommodate the swinging and displacement of the cover.

Various means can be provided for locking the cover in its limiting positions and for assuring sealing of the container.

BRIEF DESCRIPTION OF THE DRAWING

The above and other objects, features and advantages of the present invention will become more apparent from the following description, reference being made to the accompanying drawing in which.

SPECIFIC DESCRIPTION

Figure 1:
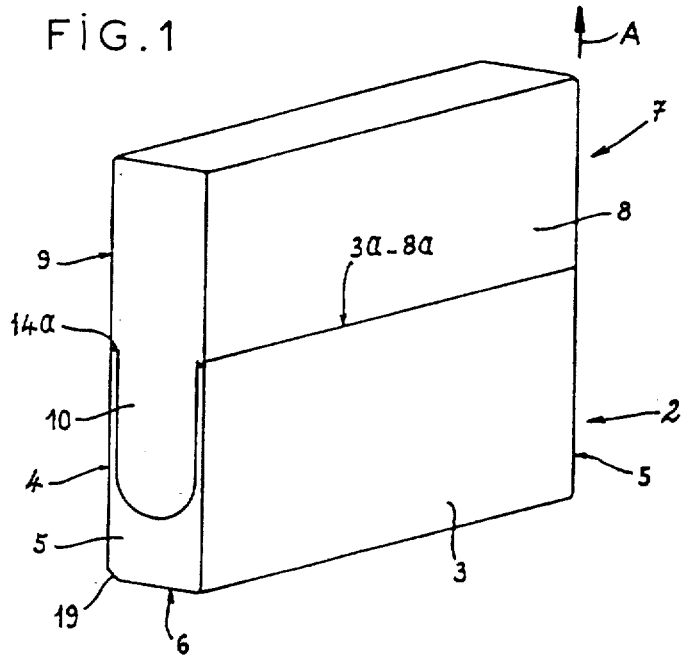
FIG. 1 is a perspective view of the container according to the invention in its closed position.

As can be seen from the drawing, the container of the invention is generally in the form of a rectangular parallelepiped and comprises a cover 7 and a lower member 2 which, at least as to the respective front and rear walls are complementary so that these walls are flush with one another in the closed position of the cover seen in FIG. 1.

The lower member 2 thus has a front wall 3, a rear wall 4, two lateral flanks or side walls 5 and a bottom 6 in a box-like construction. Correspondingly, the cover 7 has a front wall 8, a rear wall 9 and a pair of side walls 10*a*.

Figure 2:
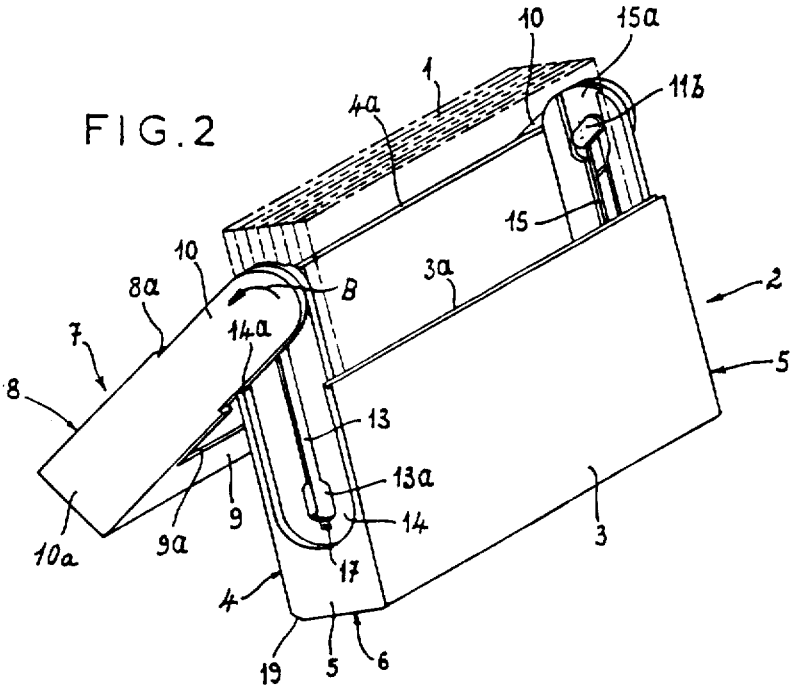
FIG. 2 is a perspective view of the container in its open or display position, the contents of the container being represented in phantom lines.

The operation of the apparatus can best be understood by a comparison of FIGS. 1 and 2. To open the container, the cover 7 is first drawn upwardly (arrow A) until its front wall 8 can clear the contents of the container and then is rotated rearwardly as represented by arrows B (FIG. 2) through less than 180° to thereby position the cover behind the lower member 2 so that it can prop-up this lower member in the display or access position shown in FIG. 2.

To this end, the front wall 8 of the cover 7 has a height which is greater than that of the rear wall 9. The lower edge of each of the walls 8 and 9 is preferably beveled with at least one and, if desired, a pair of bevels in a male or female cross-section to engage the complementarily beveled upper edges of the front and rear walls of the lower member. Thus, the male beveled edge 8*a* can fit into the groove 3*a* formed by the upper edge of the wall 3 and the bevel 9*a* can engage the complementary bevel 4*a* at the upper edge of the wall 4.

Figure 4:
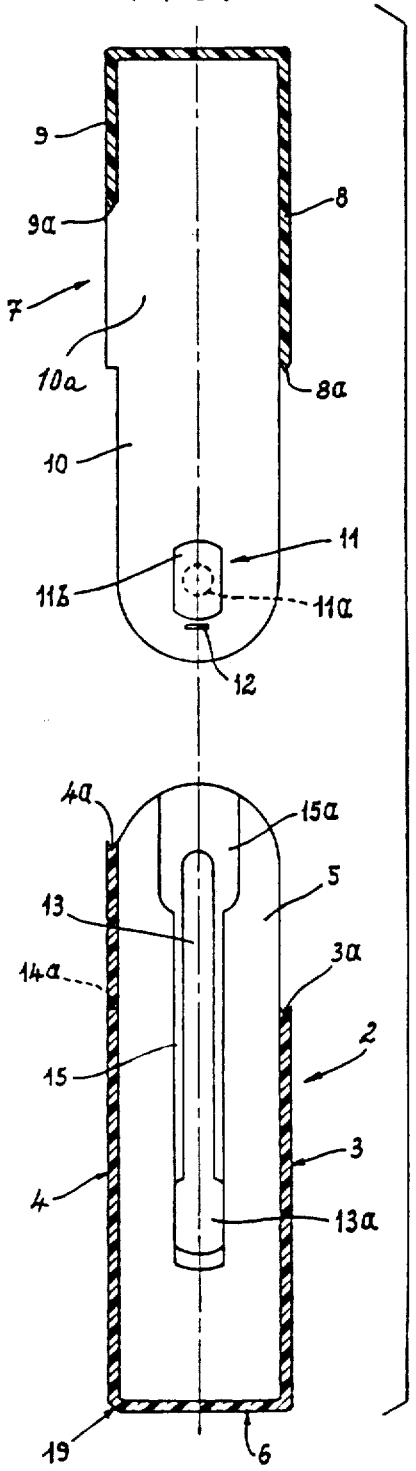
FIG. 4 is a transverse section through the container with the cover separated from the lower member.
Figure 3:
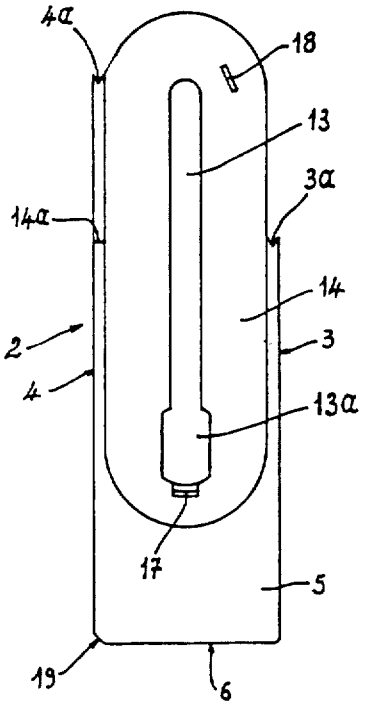
FIG. 3 is a side view of the lower member of the container.

The flanks of the cover 7 are elongated laterally by two arms 10 which extend substantially the full height of the lower member 2 as can be seen from FIGS. 1, 3 and 4.

Each arm 10 is provided at its lower end with an inwardly projecting pin 11 and each pin 11, in turn, has a cylindrical stem 11*a* (which can also be referred to as a foot) and is molded unilaterally with a cap or head of generally rectangular shape as shown at 11*b*. The cap and stem impart a mushroom-like configuration to the formation 11.

As can be readily seen from FIGS. 2, 3 and 4, the rear wall 4 of the lower member 2 is higher than the front wall 3 thereof. This rear wall 4 serves to support the diskettes 1 or the other contents of the container which can be viewed to a significant extent because of the much smaller height of the front wall 3, thereby enabling study of the contents of the container and removal thereof.

A longitudinal slot 13 is formed along each lateral wall 5 of the lower member 2.

The slots 13 extend close to the total height of each side wall 5 and have a length greater than the difference in height between the rear wall 4 and the front wall 3 of the lower member 2. The width of each slot is slightly greater than the diameter of the stem 11*a* of the pin 11 to permit sliding of the latter along the respective lateral side of the lower member 2.

Each of the slots 13 is undercut at 15 along its length to receive the head 11*b* and prevent rotation of the cover with respect to the lower member 2 until the pin has reached an upper portion of the slot.

At a lower portion 13*a* of each slot, a recess is formed by a keyhole shape dimensioned to permit the head 11*b* to be snapped into place and passed through this slot. This, of course, facilitates mounting of the cover to the lower member.

A cavity 14 is provided on the external face of each lateral side 5. This cavity 14 is dimensioned with respect to its depth, length and width to accommodate the respective arm 10 of the cover 7. Thus, even the arms are flush with the side walls 5 in the closed position of the container.

The cavity 14 joins the rear face 4 at a pair of shoulders 14*a* serving as abutments at the upper ends of the arms 10 for the cover in its closed position and thus retains the cover effectively in place.

Each of the undercuts 15 of the slot 13 also extends substantially the full length thereof to prevent pivotal movement of the cover as previously mentioned. At the upper ends of the slots, however, the undercuts are enlarged at 15*a* to allow the heads 11*b* to rotate when the pins 11 reach the tops of these slots.

As is the case for the cavity 14, the depth of the recess 15 and its enlargement 15*a* corresponds in thickness to that of the head 11 of the pin 11 so that the surface of this head is coplanar with the inner flanks of the side wall 5 through which it passes.

A groove or notch 17 whose dimensions correspond to that of the tooth 12 is provided at each external flank of the side wall 5 below the slot 13. The groove 17 thus receives the tooth 12 to lock the cover releasably in its closed position. Since the parts of the container are molded from synthetic resin material, the lifting of the cover relative to the lower member 2 can enable the tooth to pass out of the groove.

Similarly, a groove 18 is provided on the external face of each side wall 5 in a position which enables it to be engaged by the respective tooth 12 to releasably lock the cover 7 in the position shown in FIG. 2. A chamfer 19 is provided on the lower rear edge of the lower member 2 to provide a support surface for the container in its open position as seen in FIG. 2.

To open the container, the cover 7 is drawn upwardly and the pins 11 are guided in the slots 13 until the heads 11*b* reach the enlargement 15*a* at which time the cover can be swung rearwardly until the teeth 12 lock into the grooves 18. The cover 7 is thus swung rearwardly to form a pedestal enabling the container to rest on the chamfer 19 with a slight rearward inclination as shown in FIG. 2 and, without disturbing the contents or inconveniencing the manipulations of the container, one can view the contents and have access to them. The mating edges 3*a*, 8*a* and 4*a*, 9*a* ensure a tight closure when the cover is returned to its closed position in the opposite direction.

The container can be provided with partitions and the bottom of the lower member with grooves or ribs to hold the contents in place and facilitate display of pencils and the like in an ordered manner.

I claim:

1. A generally parallelepipedal container for objects to be displayed and stored which comprises:

an upwardly open lower member having a front wall, a rear wall of a height greater than that of said front wall, a pair of opposite side walls and a bottom wall;

an upper member forming a cover complementary to said lower member and having a front wall, a rear wall and side walls, said side walls of said upper member being elongated to form arms extending toward a lower portion of said lower member in a closed position of said containers whereby said front and rear walls of said upper member are substantially coplanar respectively with said front and rear walls of said lower member; and mutually engaging means on said arms and said side walls of said lower member for defining a linear path of said upper member relative to said lower member over a length at least equal to the difference in heights between said front and rear walls of said lower member and thereafter permitting said upper member to swing rearwardly relative to said lower member and form a stand enabling display of contents of said lower member, said means including on each of said arms a respective pin projecting inwardly, and a respective longitudinally extending slot formed in each of said side walls and receiving respectively one of said pins whereby said pins are displaceable along said slots, each of said arms being formed with a tooth adapted to be releasably received in a groove formed in the respective side wall of said lower member for releasably retaining said members in a closed position, another groove being formed in each side wall of said lower member at a respective upper portion for receiving a respective said tooth in an upper position of said container for retaining said upper member in said open position.

2. The container defined in claim 1 wherein each of said pins comprises a stem received in a respective slot and formed inwardly thereof with a substantially rectangular head, each of said slots having an undercut in which the respective head is guided to prevent premature rotation of the respective stem in the respective slot.

3. The container defined in claim 2 wherein each undercut is formed at an upper end with an enlargement adapted to receive and permit rotation of the respective head.

4. The container defined in claim 3 wherein each enlargement has a depth corresponding to the thickness of the respective head.

5. The container defined in claim 3 wherein each of said slots has a window at a lower end thereof adapted to pass the respective head for assembly of said members.

6. The container defined in claim 1 wherein each of said side walls has a cavity shaped and dimensioned to receive the respective arm in the closed position.

7. The container defined in claim 1 wherein the front and rear walls of said upper and lower members are formed with mating bevelled formations sealingly engaged in a closed position of said members.

8. The container defined in claim 1 wherein said bottom wall and said rear wall of said lower member adjoin in a chamber supporting said container in an open position thereof.

9. A rectangular parallelepipedal container for objects to be displayed and stored, said container consisting of:

an upwardly open lower member having a front wall, a rear wall of a height greater than that of said front wall, a pair of opposite side walls and a bottom wall, each of said side walls being formed with a peripherally closed longitudinal throughgoing slot having a laterally enlarged lower end; and an upper member forming a cover complementary to said lower member and defining a rectangular parallelepiped exclusively therewith in a closed position of said upper member, said upper member having a front wall, a rear wall and side walls, said side walls of said upper member being elongated to form arms extending toward a lower portion of said lower member and flanking the side walls thereof, said front walls being substantially coplanar and said rear walls being substantially coplanar in said closed position, each of said arms having on an inner side thereof at a free end a respective pin engageable in a respective said slot of a side wall of said lower member, said pins each being formed with a respective head dimensioned to pass into the respective enlarged lower end of the respective slot and enabling the respective pin to slide longitudinally therein, said pins being rotatable in the respective slots, said pins being insertable into said slots upon resilient deflection of said arms over said lower member whereby said pins constitute the sole means for retaining said upper member pivotally connected to said lower member for movement into an open position relative to said lower member, and in said closed position, each of said side walls of said lower member being formed along the respective slot with an undercut along opposite edges upwardly from the laterally enlarged lower end, and a recess along an interior surface of each side wall at an upper end of the respective slot, said undercuts guiding said heads against rotation as said heads move upwardly to the respective recesses, said recesses being dimensioned to permit rotation of said heads exclusively at the respective upper end of the respective slot.

* * * * *